United States Patent [19]

Krankkala

[11] 4,380,565

[45] Apr. 19, 1983

[54] COLOR PRESERVATION OF WAX-COATED PAPERBOARD

[75] Inventor: Paul L. Krankkala, Woodbury, Minn.

[73] Assignee: Champion International Corporation, Stamford, Conn.

[21] Appl. No.: 338,020

[22] Filed: Jan. 8, 1982

[51] Int. Cl.[3] ..... B32B 3/28; B32B 29/00

[52] U.S. Cl. ..... 428/182; 427/407.1; 427/411; 427/412.2; 427/416; 427/419.1; 427/419.7; 427/419.8; 428/184; 428/186; 428/341; 428/342; 428/411; 428/484; 428/486; 428/537; 428/696

[58] Field of Search ..... 428/486, 186, 537, 696, 428/411, 341, 342, 484, 179, 182, 184; 427/407.1, 411, 412.2, 416, 419.1, 419.8, 419.7

[56] References Cited

U.S. PATENT DOCUMENTS

| | | | |
|---|---|---|---|
| 2,559,749 | 7/1951 | Benning | 526/229 |
| 2,677,700 | 5/1954 | Jackson | 8/115.6 |
| 3,020,176 | 2/1962 | Robinson | 428/537 |
| 3,036,130 | 5/1962 | Jackson | 252/8.9 |
| 3,083,224 | 3/1963 | Brace | 260/955 |
| 3,094,547 | 6/1963 | Heine | 260/944 |
| 3,112,241 | 11/1963 | Mackenzie | 162/164.6 |
| 3,556,930 | 1/1971 | Scarvelis | 162/158 |
| 3,767,439 | 10/1973 | Moyer | 260/944 |

*Primary Examiner*—Ellis P. Robinson
*Attorney, Agent, or Firm*—Evelyn M. Sommer

[57] ABSTRACT

An improved wax-coated paper is produced by coating a paper or paperboard substrate with a mixture of (A) a fluorinated organic phosphate compound; and (B) a poly(oxypropylene)poly(oxyethylene) block copolymer surfactant. The coated paper is thereafter impregnated with wax. Wax penetration into the paper surface layer is eliminated to provide a more economical product of improved appearance.

12 Claims, No Drawings

COLOR PRESERVATION OF WAX-COATED PAPERBOARD

FIELD OF THE INVENTION

This invention relates to an improved process for the preparation of wax-coated paper and paperboard and to the product produced thereby. More particularly, the invention relates to a wax coated paper or paperboard wherein the wax coating is chemically prevented from penetrating into the substrate, thus resulting in an improved appearance.

DESCRIPTION OF THE PRIOR ART

Wax-coated or impregnated cellulosic products such as wax-coated corrugated paperboard are used extensively when water and moisture resistance are required in the cellulose product. Typical processes for producing such products involve passing the corrugated paperboard under a cascading apparatus whereby the paperboard is impregnated and coated with molten wax. Wax-impregnated paperboard products produced in this manner commonly have a blackish-brown color as a result of wax penetration into the paperboard. The product appears to be dirty and cannot be used in applications where color is an important consideration. Furthermore, treating printed paper in this manner obscures the printing.

Penetration of wax into paperboard additionally results in increased production costs, since it is necessary to use sufficient wax to both impregnate the board internally and provide an outer wax layer when desired.

U.S. Pat. No. 3,556,930 to Scarvelis discloses the impregnation of a fiberous cellulosic web with a thermosetting resin and with a fluorohydrocarbon-chromium complex to reduce wax penetration. The resultant web is thereafter coated with wax. However, penetration of the wax into the board is only lessened, but not eliminated using such technique.

U.S. Pat. No. 3,767,439 to Moyer et al discloses functional surface coating compositions for cellulosic materials such as paper, cardboard, paperboard and the like. The coating composition is a mixture of 0.05 to 10 percent by weight of an active fluorine-containing phosphate material with 90 to 99.5 percent of certain synthetic polymers or modified starches. The surface coating composition is said to increase "wax hold out." However, the use of such additional synthetic polymer or starch components in such functional surface coatings increases production costs of the treated paper product.

SUMMARY OF THE INVENTION

It has now been found that an improved wax-coated paper or paperboard product can be provided in accordance with this invention. The improved wax-coated paper or paperboard product of the invention comprises a paper or paperboard substrate bearing, in order, an intermediate layer consisting essentially of a mixture of (A) a fluorinated organic phosphate compound together with (B) a nonionic surfactant of the poly(oxypropylene)poly(oxyethylene)block copolymer type; and an outer layer of wax. The wax-coated product of the invention can be produced, for example, by the process of coating a paper or paperboard substrate with the fluorinated organic phosphate-surfactant mixture; drying the coating; and thereafter cascading the coated paper or paperboard with molten wax.

The wax-cascaded paper product of the invention is attractive in appearance, and is the color of the original paper product. Furthermore, any printing on the paper or paperboard retains its original brightness and coloration. Wax penetration into the paperboard is eliminated without using thermosetting resin or starch in preparing the wax-coated paper products of the present invention.

DETAILED DESCRIPTION OF THE INVENTION

A preferred substrate for use in the invention is untreated corrugated paperboard. Other paper products including, for example, kraft paper, paperboard and the like can also be used. It is not necessary that the substrate be impregnated with a thermosetting resin, wet strength improver or the like. However, if desired, the paper substrate can be a paper product which has been treated with conventional binders, colors, organic and inorganic pigments, stabilizers and the like or which has been pre-printed. As indicated, untreated paperboard, i.e., paperboard with no polymeric additives, is preferred.

The fluorinated organic phosphate compounds used in the invention are those having the formula:

$$(R_fL)_{3-y}Z$$

wherein $R_f$ is: $R_2(CF_2)_a$-where $R_2$ is F or H and a is an integer from 1 to 20; $(CF_3)_2CR_3(CF_2)_b$-where $R_3$ is F or H when b is O and $R_3$ is F when b is an integer from 1 to 18; or $R_4(c\text{-}C_6F_{10})$-where $R_4$ is F or $C_nF_{2n+1}$ and n is an integer from 1 to 4, and where c-designates an alicyclic structure;

L is:

$$-SO_2\overset{\overset{R_5}{|}}{N}-(CH_2)_2O-$$

where $R_5$ is an alkyl group having from 1 to 10 carbon atoms; or the group:

$$-(CH_2)_nO-$$

where n is an integer 1 or 2;

y is an integer 1 or 2; and

Z is $P(O)(OM)_x$, where x is the integer 1 or 2;

M is a water-solubilizing cation of the group consisting of alkali metal, ammonium and substituted ammonium when x is 1, and each M is independently selected from the group consisting of hydrogen, alkali metal, ammonium and substituted ammonium when x is 2.

When the cation M is an alkali metal, it is either sodium or potassium. When the cation M is a substituted ammonium salt, it may be any commonly available, water soluble, primary, secondary or tertiary amine such as methylamine, diethylamine, monoethanolamine, diethanolamine, morpholine, triethanolamine and the like. The above-described fluorinated organic phosphate compounds are known in the art and are disclosed in U.S. Pat. Nos. 2,559,749, 3,083,224, 3,112,241 and 3,094,547, which are hereby incorporated by reference.

A preferred group of fluorinated organic phosphate materials for use in this invention are those having the formula:

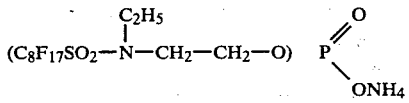

or

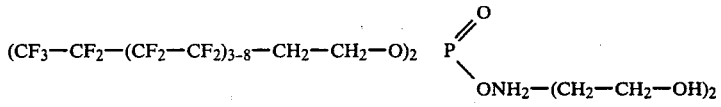

These materials are available from Minnesota Mining and Manufacturing Corporation or Dupont Chemicals as FC 807 and ZONYL RP, respectively.

The nonionic poly(oxypropylene)poly(oxyethylene)-block copolymer surfactants are likewise known in the art and are prepared by the sequential addition of propylene oxide followed by ethylene oxide to a propylene glycol base or by the sequential addition of ethylene oxide followed by propylene oxide to an ethylene glycol base. Such materials are commercially available as the PLURONIC surfactants or the PLURONIC R surfactants from BASF Wyandotte Corporation, and are disclosed in U.S. Pat. Nos. 2,677,700 and 3,036,130, which are hereby incorporated by reference. Preferred surfactants for use in this invention are those prepared by the sequential addition of ethylene oxide and then propylene oxide to an ethylene glycol base.

Certain of the nonionic surfactants, described above, may be immiscible with the fluorinated organic phosphate compounds and, therefore, cannot be used in this invention. In order to determine whether any such surfactant is useable in this invention, one need only mix a small amount of the fluorinated phosphate compound with the particular surfactant. If the materials form a single phase, then they are compatible for use in the invention. If a single phase is not formed, the surfactant cannot be used in the invention.

The fluorinated organic phosphate is applied to the paper or paperboard substrate at a concentration in an amount of between about 0.01 and about 0.12, preferably in an amount of between about 0.025 and about 0.038 pounds per thousand square feet. The non-ionic block copolymer surfactant is applied to the substrate in an amount of between about 0.015 and about 0.18, preferably between about 0.08 and about 0.12 pounds per thousand square feet. The materials may be mixed and then dissolved in a solvent, such as a lower alkanol ($C_1$–$C_5$) and water preferably, isopropanol or a mixture of isopropanol and water. The thus formed solution preferably has a total concentration of phosphate plus surfactant between about 0.75 and about 4.5 percent by weight, preferably between about 1 and about 3 percent by weight.

The solution of the mixture of copolymer surfactant and fluorinated organic phosphate can be applied to the paper or paperboard substrate by any conventional process such as brushing, spraying, roller-coating or the like. The thus provided coating can be dried by exposure to air at ambient temperatures or by a mild heating of the surface.

Thereafter the pretreated paper or paperboard product is coated with molten wax by any conventional means such as by passing the board under a wax cascade or curtain coating apparatus. The fluorochemical-surfactant sizing prevents impregnation of wax into the paper. An additional wax and cost savings is thus realized which offsets or exceeds the cost of the fluorochemical sizing. Moreover, as a result of the fluorochemical-surfactant treatment, an additional layer of wax can be retained on the surface of the fluorochemical-surfactant layer by controlling the temperature conditions during the cascading operation. Wax cascaders typically employ a cascading section where wax impregnation occurs. This section is followed by a heated section where excess wax is allowed to drain from the corrugated board. If the temperature is maintained properly in this section i.e., low enough, a layer of wax will remain on the board surface. This layer of wax functions to enhance the moisture vapor barrier properties of the structure if needed.

The following example serves to illustrate the invention.

EXAMPLE 1

One pound of a fluorinated organic phosphate of the formula

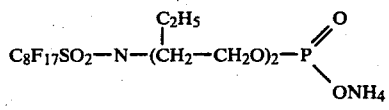

is mixed with one pound of a nonionic poly(oxyethylene)poly(oxypropylene) block copolymer surfactant (PLURONIC 17R1) and the mixture is added to a solvent consisting of 88 lbs. of water and 10 lbs. of isopropanol.

The thus prepared mixture is coated onto the double back liner of a corrugated paperboard substrate in an amount of 10 wet pounds per thousand square feet by means of a roll coating apparatus. The sizing coating is dried by means of a drum drier located prior to the double-face glue machine on the corrugator.

The resultant coated-paperboard is passed under a wax cascading apparatus where wax at a temperature of 250° F. impregnates the board. The resultant board is the color of the original paperboard. Thus, printing is not obscured by the dark brown color which would occur with untreated liner.

Although the invention has been described in detail with reference to specific preferred embodiments, variations and modifications can be made without departing from the scope of the invention as described in the foregoing specification and defined in the appended claims.

What is claimed is:

1. An improved wax-coated cellulosic product which comprises a paper or paperboard substrate bearing in order: (1) an intermediate layer consisting essentially of a mixture of (A) a fluorinated organic phosphate compound of the formula $$(R_fL)_{3-y}Z$$

wherein $R_f$ is $R_2(CF_2)_a$ where $R_2$ is F or H and a is an integer from 1 to 20, $(CF_3)_2CR_3(CF_2)_b$ where $R_3$ is F or H when b is O and $R_3$ is F when b is an integer from 1 to 18, or $R_4(c\text{-}C_6F_{10})$ where $R_4$ is F or $C_nF_{2n+1}$ in which n is an integer from 1 to 4 and c-designates an alicyclic structure, L is $$-SO_2\overset{\overset{R_5}{|}}{N}-(CH_2)_2O-$$

where $R_5$ is an alkyl group having from 1 to 10 carbon atoms, or the group $$-(CH_2)_nO-$$

where n is a integer 1 or 2, y is an integer 1 or 2, and Z is $P(O)(OM)_x$ where x is the integer 1 or 2, and M is a water-solubilizing cation selected from the group consisting of alkali metal, ammonium and substituted ammonium when x is 1, and each M is independently selected from the group consisting of hydrogen, alkali metal, ammonium and substituted ammonium when x is 2, in an amount of between about 0.01 to about 0.12 pounds per thousand square feet of said intermediate layer and (B) a nonionic surfactant of the poly(oxypropylene)poly(oxyethylene) block copolymer type in an amount of between about 0.015 and about 0.18 pounds per thousand square feet of said intermediate layer; and (2) an outer layer of wax.

2. The improved wax-coated cellulosic product of claim 1, wherein the fluorinated organic phosphate is present in said intermediate layer in a amount of between about 0.025 and about 0.038 pounds per thousand square feet.

3. The improved wax-coated cellulosic product of claim 1, wherein the fluorinated organic compound has the formula

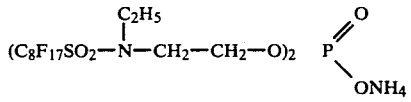

or

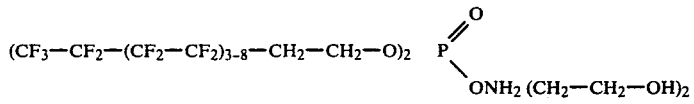

4. The improved wax-coated cellulosic product of claim 3, wherein the nonionic surfactant is present in said intermediate layer in an amount of between about 0.08 and about 0.12 pounds per thousand square feet.

5. The improved wax-coated cellulosic product of claim 2, wherein the nonionic surfactant is of the type prepared by the sequential addition of ethylene oxide followed by propylene oxide to an ethylene glycol base.

6. The improved wax-coated cellulosic product of claim 5, wherein the substrate is corrugated paperboard.

7. A process for preparing an improved wax-coated cellulosic product which comprises the steps of: (1) providing a paper or paperboard substrate: (2) coating the substrate with a mixture consisting essentially of (A) a fluorinated organic phosphate having the formula $$(R_fL)_{3-y}Z$$

wherein $R_f$ is $R_2(CF_2)_a$ where $R_2$ is F or H and a is an integer from 1 to 20, $(CF_3)_2CR_3(CF_2)_b$ where $R_3$ is F or H when b is O and $R_3$ is F when b is an integer from 1 to 18, or $R_4(c\text{-}C_6F_{10})$ where $R_4$ is F or $C_nF_{2n+1}$ in which n is an integer from 1 to 4 and c-designates an alicyclic structure, L is $$-SO_2\overset{\overset{R_5}{|}}{N}-(CH_2)_2O-$$

where $R_5$ is an alkyl group having from 1 to 10 carbon atoms, or the group $$-(CH_2)_nO-$$

where n is an integer 1 or 2, y is an integer 1 or 1, and

Z is $P(O)(OM)_x$ where x is the integer 1 or 2, and M is a water-solubilizing cation selected from the group consisting of alkali metal, ammonium and substituted ammonium when x is 1, and each M is independently selected from the group consisting of hydrogen, alkali metal, ammonium and substituted ammonium when x is 2, in an amount of between about 0.01 and about 0.2 pounds, per thousand square feet, and (B) a poly(oxypropylene)-poly(oxethylene)block copolymer surfactant in an amount of between about 0.015 and about 0.18 pounds per thousand square feet of said intermediate layer and drying the resulting coated substrate; and (3) coating said coated substrate with molten wax.

8. The process of claim 7, wherein said fluorinated organic phosphate has the formula

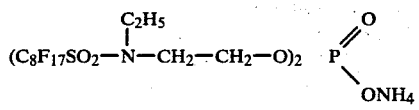

or

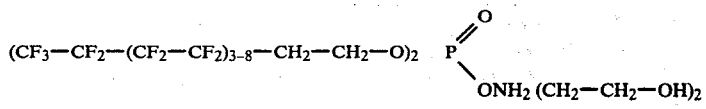

9. The process of claim 8, wherein the substrate consists essentially of paperboard.

10. The process of claim 9, wherein the nonionic surfactant is of the type prepared by the sequential addition of ethylene oxide followed by propylene oxide to an ethylene glycol base.

11. The process of claim 10, wherein the fluorinated organic phosphate is applied to the paperboard substrate in an amount of between about 0.025 and about 0.038 pounds per thousand square feet.

12. The process of claim 11, wherein the nonionic surfactant is applied to the paperboard substrate in an amount of between about 0.08 and about 0.12 pounds per thousand square feet.

* * * * *